US007595625B2

(12) United States Patent
Sirito-Olivier et al.

(10) Patent No.: US 7,595,625 B2
(45) Date of Patent: Sep. 29, 2009

(54) CURRENT MIRROR

(75) Inventors: Philippe Sirito-Olivier, Carro par Martigues (FR); Mario Chiricosta, Messina (IT)

(73) Assignees: STMicroelectronics S.A., Montrouge (FR); STMicroelectronics S.r.l., Agrate Brianza (IT)

( * ) Notice: Subject to any disclaimer, the term of this patent is extended or adjusted under 35 U.S.C. 154(b) by 373 days.

(21) Appl. No.: 11/511,526

(22) Filed: Aug. 28, 2006

(65) Prior Publication Data

US 2007/0052402 A1 Mar. 8, 2007

(30) Foreign Application Priority Data

Sep. 1, 2005 (EP) ..... 05291823

(51) Int. Cl.
*G05F 3/16* (2006.01)

(52) U.S. Cl. ..... 323/315; 330/267; 327/66

(58) Field of Classification Search ..... 323/312, 323/315; 327/53, 56, 66, 68, 81, 538, 543, 327/540, 541, 542; 330/257, 258, 267
See application file for complete search history.

(56) References Cited

U.S. PATENT DOCUMENTS 4,453,134 A * 6/1984 Pernyeszi ..... 330/255
5,617,056 A * 4/1997 Main et al. ..... 327/538
5,825,167 A * 10/1998 Ryat ..... 323/312
6,586,998 B2 * 7/2003 Moraveji ..... 330/267

OTHER PUBLICATIONS

Patent Abstracts of Japan, vo. 015, No. 108 (E-1045), Mar. 14, 1991 which relates to JP 03 001707 A (Sharp Corp.), Jan. 8, 1991.
Patent Abstracts of Japan, vol. 1999, No. 07, Mar. 31, 1999 which relates to JP 07 212141 a (Korea Electron Telecommun), Aug. 11, 1995.
Patent Abstracts of Japan, vol. 016, No. 215 (E-1204), May 20, 1992 which relates to JP 04 035511 A (Fujitsu Ltd.), Feb. 6, 1992.
Paul R. Gray & Robert G. Meyer, "Analysis and Design of Analog Integrated Circuits," Chapter 4, Transistor Current Sources and Active Loads, pp. 272-276 and 316-321, date unknown.
European Search Report, EP 05 29 1823, dated Jun. 23, 2006.

* cited by examiner

*Primary Examiner*—Edward Tso
*Assistant Examiner*—M'Baye Diao
(74) *Attorney, Agent, or Firm*—Gardere Wynne Sewell LLP

(57) ABSTRACT

A current mirror includes at least a first and a second mirror transistors inserted between a first and a second voltage reference and connected to an input terminal and to an output terminal of the current mirror, respectively. The current mirror further includes a base current compensation block inserted between the input terminal and common control terminals of the first and second mirror transistors and connected to a voltage reference. The base current compensation block at least includes a bias current generator of a bias current and a first compensation transistor inserted, in series to each other, between the voltage reference and the input terminal, and a second compensation transistor inserted between the voltage reference and the common control terminals of the mirror transistors and having a control terminal connected to a control terminal of the first compensation transistor.

25 Claims, 3 Drawing Sheets

CURRENT MIRROR

PRIORITY CLAIM

The present application claims priority from European Patent Application No. 05291823.2 filed Sep. 1, 2005, the disclosure of which is hereby incorporated by reference.

BACKGROUND OF THE INVENTION

1. Technical Field of the Invention

The present invention relates generally to a current mirror.

More specifically, the invention relates to a current mirror of the type comprising at least a first and a second mirror transistors inserted between a first and a second voltage reference and connected to an input terminal and to an output terminal of the current mirror, respectively. A base current compensation block is inserted between said input terminal and common control terminals of the first and second mirror transistors and connected to a voltage reference.

2. Description of Related Art

As it is well known, current mirrors are widely used in all kinds of electronic circuits. Basically, a current mirror is a circuit designed to copy a current flowing through one active device by controlling a current in another active device, keeping an output current of an output terminal of the current mirror constant regardless of loading values applied to the output terminal itself.

A current mirror realized by using bipolar transistors is schematically shown in FIG. 1.

In particular, the current mirror 1 comprises a first or input leg comprising a current generator G1 issuing a reference current Iref, a first mirror transistor Q1 and a first emitter resistor R1, inserted, in series with each other, between a first and a second voltage reference, in particular a supply voltage reference Vcc and ground GND.

Furthermore, the current mirror 1 comprises a second or output leg comprising a second mirror transistor Q2 and a second emitter resistor R2, inserted, in series with each other, between an output terminal OUT of the current mirror 1 and ground GND.

The first and second mirror transistors, Q1 and Q2, are bipolar transistors and have their base terminals connected to each other.

To increase current mirror accuracy, a classic solution is to use emitter resistors and a base current compensation block, as shown in FIG. 1 and globally indicated at 2.

In particular, the base current compensation block 2 is connected to the common base terminals of the mirror transistors, Q1 and Q2, and to the collector terminal of the first mirror transistor Q1. The collector terminal of the first mirror transistor Q1 is also the input terminal IN of the current mirror 1.

The base current compensation block 2 is used to compensate the base currents of the first and second mirror transistors, Q1 and Q2. A well known realization of this block is described in Analysis and Design of Analog Integrated Circuits, Paul R. Gray, Robert G. Meyer, Third edition, page 276, and schematically shown in FIG. 2.

In particular, the base current compensation block 2 comprises a compensation transistor Q3, inserted between the supply voltage reference Vcc and the common control or base terminals of the mirror transistors, Q1 and Q2, and having a base terminal connected to the collector terminal of the first bipolar mirror transistor Q1. The compensation transistor Q3 is a bipolar transistor.

It can be verified that the compensation transistor Q3 reduces the error of an output current of the output terminal OUT according to the following equation:

$$Iout = \frac{Iref}{1 + \frac{2}{\beta_F(\beta_F + 1)}} \tag{1}$$

where Iout is the output current, Iref is the reference current and βF is the bipolar current gain of Q1, Q2 and Q3 (supposed to be equal at a first order approximation).

Moreover, the first and second emitter resistors, R1 and R2, increase the matching of the current mirror 1, as explained in the above cited handbook, pages 317 to 320.

Also known is an alternative realization of the base current compensation block 2 using a MOS transistor M3, as shown in FIG. 3.

In this case, as the gate current of a MOS transistor is zero, the output current Iout is equal to the reference current Iref and the base currents of the first and second bipolar mirror transistors, Q1 and Q2, are supplied by the MOS transistor M3.

While advantageous from many points of view, the known solution has shown several drawbacks, among which is the fact that an input voltage applied to the collector terminal of the first mirror transistor Q1 should be higher than a threshold value, which turns out to be too high in many applications. In particular, such a threshold voltage is:

- 2×Vbe+R1×Iref, for the base current compensation block 2 realized by a bipolar transistor and shown in FIG. 2, or
- Vgs+Vbe+R1×Iref, for the base current compensation block 2 realized by a MOS transistor and shown in FIG. 3, where:

- Vbe is the base-emitter voltage of the first mirror transistor Q1; and
- Vgs is the gate source voltage of the MOS transistor M3.

As an example, if Vbe=0.8V, Vgs=1V and R1×Iref=0.2V (which are common amounts for these values) the minimum input voltage is about 1.8V or 2V, increasing to 2V or 2.3V with temperature and process variations.

SUMMARY OF THE INVENTION

There is a need for providing a current mirror having structural and functional characteristics which allow it to obtain a good accuracy and a low input voltage, regardless of output voltage.

An embodiment of the present invention is directed to a base current compensation block able to reduce the voltage value at the collector terminal of the first mirror transistor of the current mirror.

A further embodiment of the present invention is a current mirror of the type comprising at least a first and a second mirror transistors inserted between a first and a second voltage reference and connected to an in put terminal and to an output terminal of the current mirror, respectively. The current mirror further comprises a base current compensation block inserted between the input terminal and common control terminals of the first and second mirror transistors and connected to a voltage reference. The base current compensation block at least comprises: a bias current generator of a bias current and a first compensation transistor inserted, in series to each other, between the voltage reference and the input terminal; and a second compensation transistor inserted between the voltage reference and the common control terminals of the mirror transistors and having a control terminal connected to a control terminal of the first compensation transistor.

In an embodiment, a base current compensation block for a current mirror circuit comprises a bias current generator of a bias current and a first compensation transistor inserted, in series with each other, between a voltage reference and an input terminal of the current mirror circuit, a second compensation transistor inserted between the voltage reference and a common control terminal node of a pair of transistors in the current mirror circuit and having a control terminal connected to a control terminal of the first compensation transistor, and a third compensation transistor inserted between the voltage reference and common control terminals of the first and second compensation transistors, and having a control terminal connected between the bias current generator and the first compensation transistor.

In accordance with another embodiment, a current mirror comprises a first and a second mirror transistors inserted between a first and a second voltage reference and connected to an input terminal and to an output terminal of the current mirror, respectively. A first bias current generator of a first bias current is connected in series with the first mirror transistor. The circuit further includes a second bias current generator of a second bias current and a first compensation transistor inserted, in series with the second bias current generator, between a voltage reference and the input terminal. A second compensation transistor is inserted between the voltage reference and the common control terminals of the first and second mirror transistors and has a control terminal connected to a control terminal of the first compensation transistor.

The characteristics and advantages of the current mirror according to embodiments of the invention will be apparent from the following description of embodiments thereof given by way of indicative and non limiting example with reference to the annexed drawings.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 4:
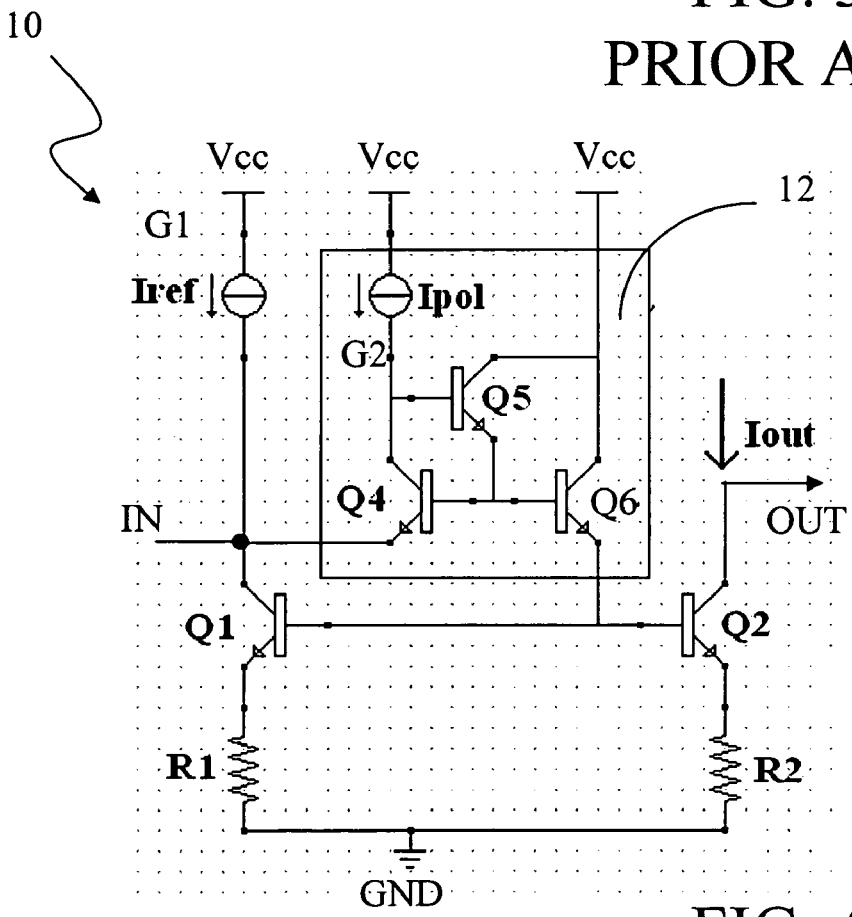
FIG. 4 schematically shows a current mirror realized according to an embodiment of the present invention.

With reference to such figures, and in particular to FIG. 4, a current mirror realized according to an embodiment of the present invention is schematically shown and globally indicated at 10.

To structurally and/or functionally equal elements with respect to the circuits described in the prior art section, same reference numbers will be applied.

As already described with reference to current mirrors realized according to the prior art, the current mirror 10 comprises a first or input leg in turn including a current generator G1 issuing a reference current Iref, a first mirror transistor Q1 and a first emitter resistor R1, inserted, in series with each other, between a first and a second voltage reference, in particular a supply voltage reference Vcc and ground GND.

Furthermore, the current mirror 10 comprises a second or output leg comprising a second mirror transistor Q2 and a second emitter resistor R2, inserted, in series with each other, between an output terminal OUT of the current mirror 10 and ground GND.

The first and second mirror transistors, Q1 and Q2, are bipolar transistors and have their control or base terminals connected to each other.

Also, the current mirror 10 comprises a base current compensation block 12 connected to the common base terminals of the mirror transistors, Q1 and Q2, and to the collector terminal of the first mirror transistor Q1. The collector terminal of the first mirror transistor Q1 is also the input terminal IN of the current mirror 10.

Advantageously according to an embodiment of the invention, the base current compensation block 12 comprises a second current generator G2 of a bias current Ipol and a first compensation transistor Q4 inserted, in series with each other, between the supply voltage reference Vcc and the input terminal IN of the current mirror 10.

The base current compensation block 12 also comprises a second compensation transistor Q6 inserted between the supply voltage reference Vcc and the common base terminals of the mirror transistors, Q1 and Q2, and having a base terminal connected to a base terminal of the first compensation transistor Q4.

Finally, the base current compensation block 12 of the current mirror 10 according to an embodiment of the present invention comprises a third compensation transistor Q5 inserted between the supply voltage reference Vcc and the common base terminals of the first and second compensation transistors, Q4 and Q6, and having a base terminal connected to a collector terminal of the first compensation transistor Q4 and, thus, to the second current generator G2.

In the example shown in FIG. 4, the compensation transistors Q4, Q5 and Q6 are bipolar transistors.

Advantageously according to an embodiment of the invention, the base current compensation block 12 reduces a voltage on the collector terminal of the first mirror transistor Q1, i.e. the input voltage, to a value equal to:

$$Vbe+(Iref+Ipol)\times R1$$

where:

Vbe is the base-emitter voltage of the first mirror transistor Q1;

Iref is the reference current issued by the first current generator G1;

Ipol is the bias current issued by the second current generator G2; and

R1 is the value of the first emitter resistor connected to the first mirror transistor Q1.

It should be noted that the above voltage value is the minimum input voltage that can be reached using a current mirror comprising the emitter resistors.

Figure 1:
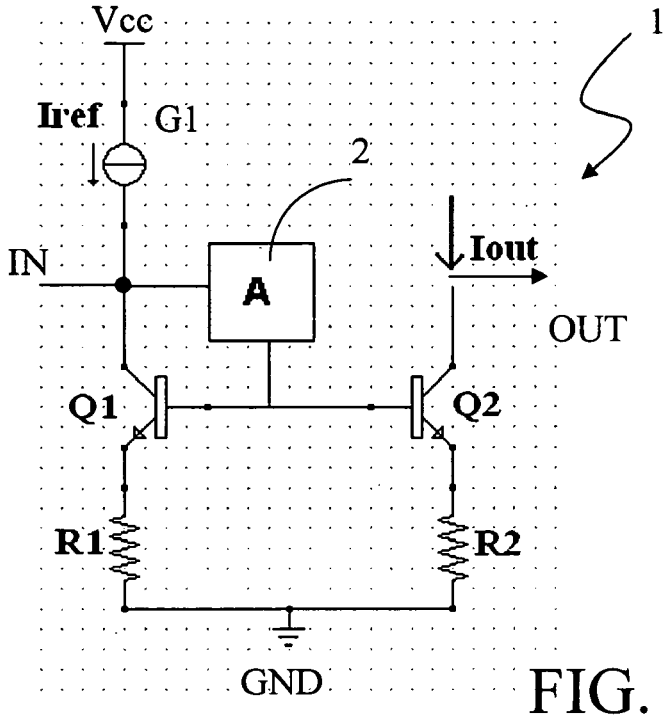
FIG. 1 PRIOR ART
FIGS. 1-3 schematically show current mirrors realized according to the prior art.

In particular, the minimum input voltage of a bipolar current mirror using the emitter resistor R1 is obtained (making reference to the prior art) when the block 2 of FIG. 1 is a simple short circuit between the collector and base of Q1.

However, in that case, the current error calculated according to the above referred equation 1 is higher and equal to:

$$Iout = \frac{Iref}{1 + \frac{2}{\beta_F}}$$

Using common values for the transistors and resistors comprised in the current mirror 10, an input voltage value of 1-1.2V can be obtained.

The current mirror 10 shown in FIG. 4 has an output current Iout given by the following equation:

$$Iout = \frac{Iref + \frac{(\beta_F + 1)^2}{\beta_F(\beta_F + 1) + 1} Ipol}{1 + \frac{2}{\beta_F^2(\beta_F + 1) + 1}} \quad (2)$$

where Iout is the output current, Iref is the reference current issued by the first current generator G1, Ipol is the bias current issued by the second current generator G2, and βF is the bipolar current gain of Q1, Q2, Q4, Q5 and Q6 (supposed to be equal at a first order approximation).

Figure 2:
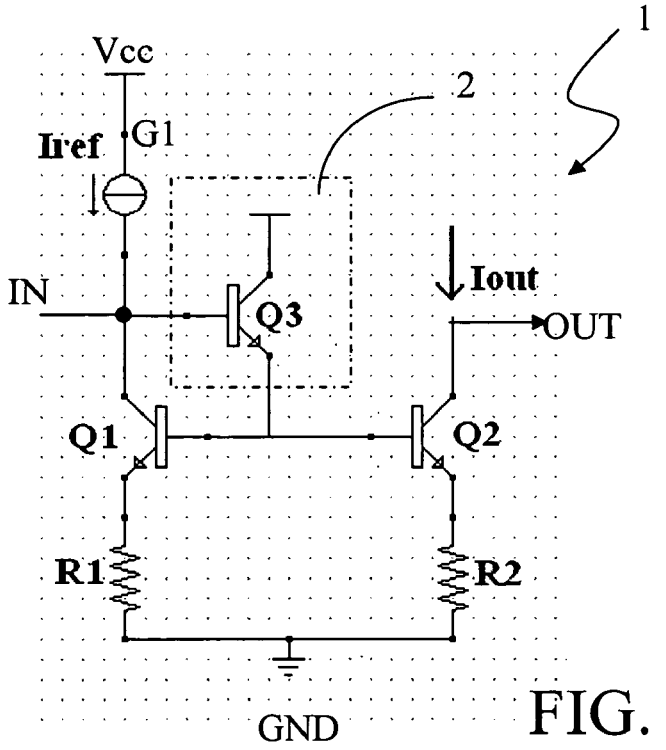
FIG. 2 PRIOR ART
Figure 3:
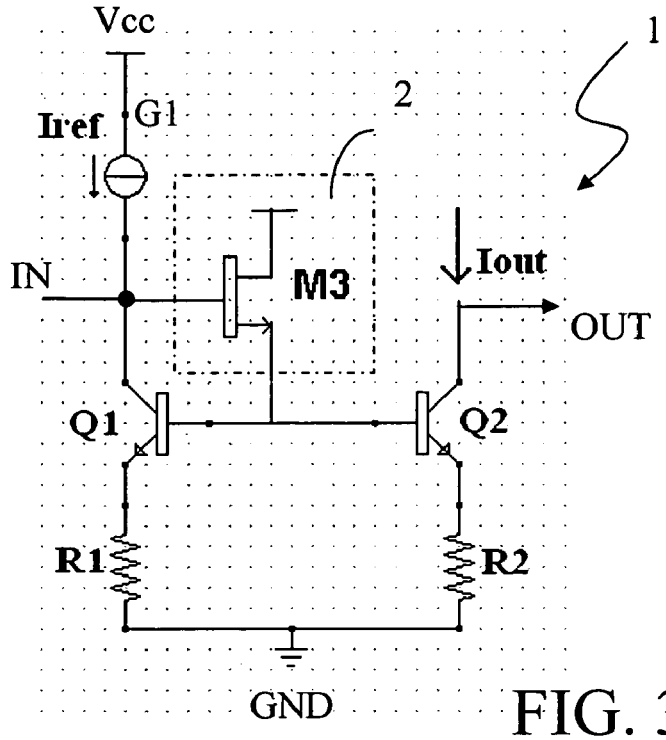
FIG. 3 PRIOR ART
Figure 5:
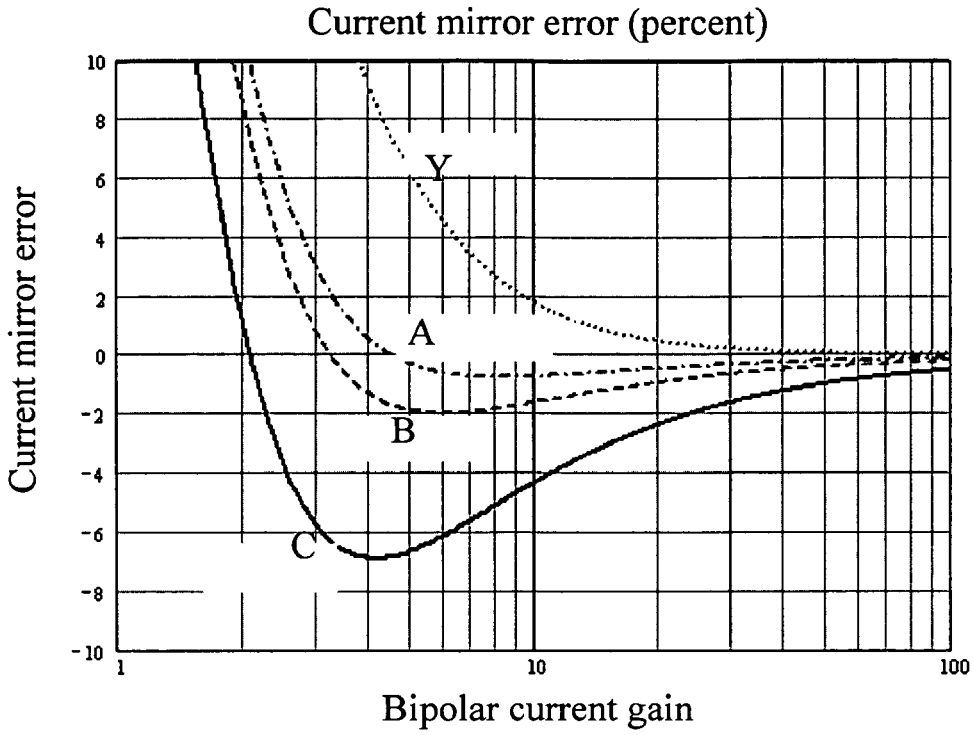
FIG. 5 schematically shows the current error patterns of the known current mirrors in comparison with the current error pattern of the current mirror according to an embodiment of the present invention.

FIG. 5 shows a comparison of the output current error of the current mirror 10 realized according to an embodiment of the invention and the known current mirror 1 as illustrated in FIG. 2.

In particular, the current mirror error here plotted is defined as:

for the known current mirror 1 illustrated in FIG. 2 (plot Y):

$$\text{Error} = \left(1 - \frac{Iout}{Iref}\right) * 100$$

for the current mirror 10 according to an embodiment of the invention:

$$\text{Error} = \left(1 - \frac{Iout}{Iref + Ipol}\right) * 100$$

Ipol being equal respectively to 50%, 20% and 10% of Iref for cases A, B, C.

From the plots of FIG. 5, it can be verified that, compared to the classic current mirror, the output current of the current mirror 10 according to an embodiment of the present invention is higher than the reference plus the bias currents (error is negative).

It should be also emphasized that, advantageously according to an embodiment of the present invention, the current mirror error can be kept low (1%) for a higher range of the bipolar current gain βF if the bias current Ipol does not exceed 10% of the reference current Iref (plot C).

Figure 6:
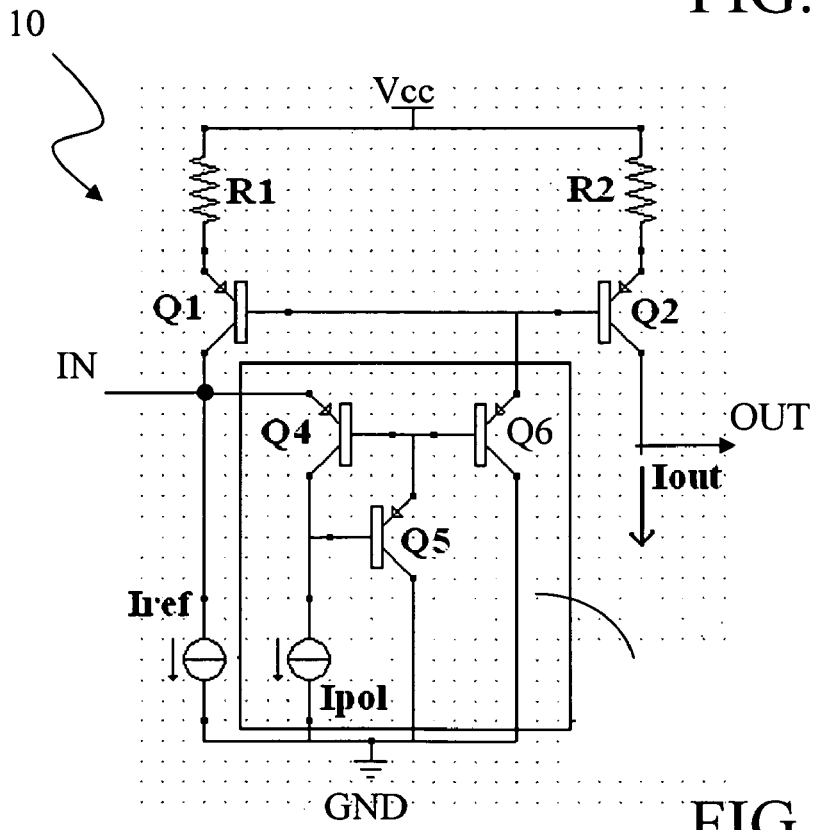
FIG. 6 schematically shows an alternative embodiment of the current mirror realized according to an embodiment of the present invention.

This can be interesting for low performance PNP transistors as shown in FIG. 6.

In this case, the mirror transistors Q1 and Q2 are P type transistors and the emitter resistors R1 and R2 are connected to the supply voltage reference Vcc.

The base current compensation block 12 is thus connected to ground GND.

It should be also remarked that, advantageously according to an embodiment of the invention, the base current compensation block 12 of the current mirror 10 also provides the same advantage (reduction of the input voltage) when emitter resistors R1 and R2 are not used.

In summary, the current mirror 10 according to an embodiment of the present invention is a bipolar current mirror having good accuracy and low input voltage, regardless of output voltage.

From the foregoing it will be appreciated that, although specific embodiments of the invention have been described herein for purposes of illustration, various modifications may be made without deviating from the spirit and scope of the invention. In particular, it is clear that the base current compensation block 12 can be also realized by using MOS transistors, and further could be realized with a combination of bipolar and MOS transistors.

Although preferred embodiments of the device of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A current mirror, comprising:

a first and a second mirror transistors inserted between a first and a second voltage reference and connected to an input terminal and to an output terminal of the current mirror, respectively; and a base current compensation block inserted between the input terminal and common control terminals of the first and second mirror transistors and connected to a voltage reference, comprising:

a bias current generator of a bias current and a first compensation transistor inserted, in series with each other, between the voltage reference and the input terminal; and a second compensation transistor inserted between the voltage reference and the common control terminals of the first and second mirror transistors and having a control terminal connected to a control terminal of the first compensation transistor;

wherein the base current compensation block further comprises:

a third compensation transistor inserted between the voltage reference and common control terminals of the first and second compensation transistors, and having a control terminal connected between the bias current generator and the first compensation transistor.

2. The current mirror of claim 1, wherein the compensation transistors are bipolar transistors.

3. The current mirror of claim 1, wherein the compensation transistors are MOS transistors.

4. The current mirror of claim 1, wherein the compensation transistors comprise a combination of bipolar and MOS transistors.

5. The current mirror of claim 1, wherein the voltage reference is one of the first and second voltage references.

6. The current mirror of claim 1, wherein the voltage reference is ground.

7. A base current compensation block for a current mirror circuit, comprising:

a bias current generator of a bias current and a first compensation transistor inserted, in series with each other, between a voltage reference and an input terminal of the current mirror circuit;

a second compensation transistor inserted between the voltage reference and a common control terminal node of a pair of transistors in the current mirror circuit and having a control terminal connected to a control terminal of the first compensation transistor; and a third compensation transistor inserted between the voltage reference and common control terminals of the first and second compensation transistors, and having a control terminal connected between the bias current generator and the first compensation transistor.

8. The current mirror of claim 7, wherein the compensation transistors are bipolar transistors.

9. The current mirror of claim 7, wherein the compensation transistors are MOS transistors.

10. The current mirror of claim 7, wherein the compensation transistors comprise a combination of bipolar and MOS transistors.

11. The current mirror of claim 7, wherein the voltage reference is a voltage supply reference.

12. The current mirror of claim 7, wherein the voltage reference is ground.

13. A current mirror, comprising:

a first and a second mirror transistors inserted between a first and a second voltage reference and connected to an input terminal and to an output terminal of the current mirror, respectively;

a first bias current generator of a first bias current connected in series with the first mirror transistor;

a second bias current generator of a second bias current;

a first compensation transistor inserted, in series with the second bias current generator, between a voltage reference and the input terminal; and a second compensation transistor having a control terminal connected to a control terminal of the first compensation transistor and having a controlled current path connected between the reference voltage and the common control terminals of the first and second mirror transistors.

14. A current mirror, comprising:

a first and a second mirror transistors inserted between a first and a second voltage reference and connected to an input terminal and to an output terminal of the current mirror, respectively;

a first bias current generator of a first bias current connected in series with the first mirror transistor;

a second bias current generator of a second bias current;

a first compensation transistor inserted, in series with the second bias current generator, between a voltage reference and the input terminal; and a second compensation transistor inserted between the voltage reference and the common control terminals of the first and second mirror transistors and having a control terminal connected to a control terminal of the first compensation transistor;

wherein the base current compensation block further comprises:

a third compensation transistor inserted between the voltage reference and common control terminals of the first and second compensation transistors, and having a control terminal connected between the second bias current generator and the first compensation transistor.

15. The current mirror of claim 14, wherein the first through third compensation transistors are bipolar transistors.

16. The current mirror of claim 14, wherein the voltage reference is a positive supply voltage references.

17. The current mirror of claim 14,wherein the voltage reference is ground.

18. The current mirror of claim 14 wherein the second bias current is substantially less than the first bias current.

19. The current mirror of claim 14 wherein the second bias current is no more than 10% of the first bias current.

20. The current mirror of claim 14 wherein the second bias current is no more than 20% of the first bias current.

21. The current mirror of claim 14 wherein the second bias current is no more than 50% of the first bias current.

22. A current mirror comprising:

a first and a second mirror transistors inserted between a first and a second voltage reference and connected to an input terminal and to an output terminal of the current mirror, respectively; and a base current compensation block inserted between the input terminal and common control terminals of the first and second mirror transistors and connected to a voltage reference, comprising:

a bias current generator of a bias current and a first compensation transistor inserted, in series with each other, between the voltage reference and the input terminal; and a second compensation transistor inserted between the voltage reference and the common control terminals of the first and second mirror transistors and having a control terminal connected to a control terminal of the first compensation transistor;

wherein the second compensation transistor is inserted to source a compensation current into the common control terminals of the first and second mirror transistors.

23. The current mirror of claim 13 wherein the controlled current path of the second compensation transistor sources a compensation current into the common control terminals of the first and second mirror transistors.

24. A current mirror, comprising:

a first transistor having a first control terminal and a first conduction terminal;

a second transistor having a second control terminal and a second conduction terminal, the first control terminal connected to the second control terminal;

a third transistor having a third control terminal and third and fourth conduction terminals, the fourth conduction terminal connected to the first conduction terminal of the first transistor;

a fourth transistor having a fourth control terminal and fifth and sixth conduction terminals, the fourth control terminal connected to the third conduction terminal of the third transistor and the sixth conduction terminal connected to the third control terminal of the third transistor;

a fifth transistor having a fifth control terminal and seventh and eighth conduction terminals, the fifth control terminal connected to the third control terminal of the third transistor, the seventh conduction terminal connected to the fifth conduction terminal, and the eighth conduction terminal connected to the first and second control terminals of the first and second transistors, respectively.

25. The current mirror of claim 24 further comprising a reference current source coupled to the first conduction terminal and a bias current source coupled to the third conduction terminal of the third transistor.

* * * * *

UNITED STATES PATENT AND TRADEMARK OFFICE

CERTIFICATE OF CORRECTION

PATENT NO. : 7,595,625 B2
APPLICATION NO. : 11/511526
DATED : September 29, 2009
INVENTOR(S) : Sirito-Olivier et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 405 days.

Signed and Sealed this

Twenty-eighth Day of September, 2010

David J. Kappos

David J. Kappos
*Director of the United States Patent and Trademark Office*